US008191748B2

(12) United States Patent
Lessman

(10) Patent No.: US 8,191,748 B2
(45) Date of Patent: Jun. 5, 2012

(54) IDENTIFICATION APPARATUS AND METHOD OF USE

(76) Inventor: Michael Lessman, Sparks, NV (US)

( * ) Notice: Subject to any disclaimer, the term of this patent is extended or adjusted under 35 U.S.C. 154(b) by 834 days.

(21) Appl. No.: 12/117,965

(22) Filed: May 9, 2008

(65) Prior Publication Data

US 2009/0276929 A1 Nov. 12, 2009

(51) Int. Cl.

| | |
|---|---|
| ***A44C 5/00*** | (2006.01) |
| ***A44C 5/04*** | (2006.01) |
| ***A45F 3/02*** | (2006.01) |
| ***A45F 3/14*** | (2006.01) |
| ***A41F 9/00*** | (2006.01) |
| ***G09F 13/16*** | (2006.01) |
| ***G09F 21/02*** | (2006.01) |

(52) U.S. Cl. ..... 224/660; 224/172; 224/175; 224/607; 224/257; 2/312; 40/582; 40/586

(58) Field of Classification Search ..... 224/660, 224/172, 175, 607, 257; 2/312; 40/582, 40/586; 24/594.1

See application file for complete search history.

(56) References Cited

U.S. PATENT DOCUMENTS

| | | | | |
|---|---|---|---|---|
| 776,193 | A * | 11/1904 | Mills | 224/602 |
| 3,499,416 | A * | 3/1970 | Thorsheim | 116/200 |
| 3,599,238 | A * | 8/1971 | Matthews | 2/1 |
| 3,931,917 | A * | 1/1976 | Zellmer | 224/602 |
| 4,137,660 | A * | 2/1979 | Dettmann et al. | 40/303 |
| 4,623,282 | A * | 11/1986 | Allen | 405/157 |
| 4,634,031 | A * | 1/1987 | Frankhouse | 224/602 |
| 5,624,065 | A * | 4/1997 | Steffe | 224/625 |
| 5,915,609 | A * | 6/1999 | Diakoulas | 224/626 |
| 6,443,347 | B1 * | 9/2002 | Elizalde et al. | 224/626 |
| 2005/0133554 | A1 * | 6/2005 | Maupin | 224/312 |
| 2007/0295772 | A1 * | 12/2007 | Woodmansee | 224/576 |

* cited by examiner

*Primary Examiner* — Nathan J Newhouse
*Assistant Examiner* — Lester L Vanterpool
(74) *Attorney, Agent, or Firm* — Holland & Hart LLP

(57) ABSTRACT

An identification apparatus and methods of use are presented. Embodiments include a loop of flexible material, having and exterior surface. Indicia, identifying an organization, is displayed on at least a portion of the exterior surface. A container is provided to store the loop of flexible material. Some embodiments couple the container with a belt or other article of clothing or clothing accessory. The loop of flexible material may be coupled with the container. The container may serve as an anchoring point for one or more methods of displaying the loop of flexible material. Some methods of use position the loop of flexible material over portions of a user's body. Some methods of use permit one hand operation of the apparatus.

19 Claims, 16 Drawing Sheets

IDENTIFICATION APPARATUS AND METHOD OF USE

BACKGROUND

Law enforcement agencies including police departments, the FBI, the ATF, and the like have frequently used undercover officers in various operations. Undercover officers in such operations were frequently armed but have been otherwise unrecognizable as members of any law enforcement organization. In many cases, detectives and undercover officers have worn plain clothes to blend in with surrounding civilian populations, which may include off duty officers and legally armed civilians. At other times, the plain clothes attire of undercover officers has evolved into disguises to blend in with the various criminal elements. Such undercover officers have at times had to go into deep cover, playing the role of a member of a criminal organization. While the roles of law enforcement officers have always been dangerous, the roles of undercover officers have been particularly dangerous. In one respect, undercover officers have always had to worry about being identified by criminal suspects as law enforcement personnel. In another respect, however, undercover officers have had to worry about not being identified as law enforcement personnel by other law enforcement personnel during an attempted apprehension of nearby suspects. Misidentifications in either respect have lead to the death or serious injury of law enforcement personnel.

In order to identify non-uniformed law enforcement personnel, various identification methods have been developed. Unfortunately, each of the prior methods have suffered from a number of serious shortcomings. In one example, undercover law enforcement personnel have, at the appropriate time, donned windbreakers having the identity of their law enforcement organization displayed on the rear panel of the windbreaker. For example, such jackets have been routinely used by organizations that include the FBI and ATF. However, it has been less than convenient for undercover agents to carry around a windbreaker. Windbreakers have presented a bulk that can only be carried within backpacks or other large containment devices that have proved inappropriate for an undercover officer to carry around. Moreover, law enforcement personnel have had to frequently use both of their hands to adequately don their identification windbreaker. It has proven difficult, if not impossible, to hold a pistol or other weapon, directed toward a suspect, while putting on an identification windbreaker.

In another example, some prior art jackets and vests have provided law enforcement identification on front and rear panels of the jackets and vests, which have had flaps that temporarily covered the identification. In these instances, the flap was typically placed in a concealing position over the identification until the law enforcement personnel was ready to identify their association with the law enforcement organization. At the appropriate time, the law enforcement personnel simply moved the concealing flap to a revealing position. Such identification systems have also proven to be highly impractical because undercover or plain clothes law enforcement personnel have not been adequately disguised when wearing such jackets and vests. While concealment flaps have covered the law enforcement organization identification, the concealment flaps have not left the design of the jacket or vest with a common, street clothes appearance. Furthermore, such jackets and vests have also suffered from their bulk, not being capable of concealment in a confined space. To be sure, such jackets and vests have had to be carried in backpacks, the trunks of cars, and the like. This has posed logistical concerns that render such jackets and vests undesirable for use by plain clothes and undercover law enforcement personnel.

In certain instances, plain clothes and undercover law enforcement personnel have used hats that display the identity of a law enforcement organization, or clipped a badge to a belt or article of clothing that would readily display the badge. Such identification devices are smaller than jackets or vests and easier to conceal. However, their size has also worked against their effectiveness. During a confrontation between law enforcement personnel and one or more suspects, events have frequently transpired too quickly for law enforcement personnel to positively identify other law enforcement personnel simply because they are wearing a particular hat or a badge. To be sure, these are not only objects that are relatively small in size but cannot be simultaneously seen from both the front and back of an individual. Moreover, such devices have not proven to be readily visible in low light conditions. Commonly, law enforcement personnel have engaged suspects during low light conditions and needed to be clearly identified to other law enforcement personnel. Simple mistakes during such conditions have resulted in serious injuries and death of valuable law enforcement personnel.

SUMMARY

This Summary is provided to introduce a selection of concepts in a simplified form that are further described below in the Detailed Description. This Summary, and the foregoing Background, are not intended to identify key aspects or essential aspects of the claimed subject matter. Moreover, this Summary is not intended for use as an aid in determining the scope of the claimed subject matter.

Various embodiments of an identification apparatus, methods of assembly, and methods for use are presented. In various embodiments, the apparatus includes a loop of flexible material having opposite end portions and an outwardly faced exterior surface. In some embodiments, the exterior surface includes a first exterior surface portion and a second exterior surface portion that are oriented to face in generally opposite directions from one another. Various embodiments of the apparatus also include indicia displayed on the exterior surface of the loop of flexible material. In some embodiments, the indicia is provided to identify the individual wearing the apparatus as a member of an organization, such as a law enforcement agency. A container may be associated with the apparatus that is sized to receive a substantial portion of the loop of flexible material within an inner chamber. In this manner, the loop of flexible material may be conveniently stored in a compact area.

In various embodiments, one end portion of the loop of flexible material is coupled with the container. In some embodiments, a cord is provided to couple the loop of flexible material with the container. In at least one embodiment, the cord is formed from a deformably resilient length of material, such as bungee cord. In some embodiments, the cord is provided to pass through openings formed in two free end portions of the loop of flexible material. An opposite end portion of the cord may, in some embodiments be secured within the inner chamber, or other structural feature of the container.

In various embodiments, the apparatus is provided with a grasping tab that extends outwardly from the exterior surface of the loop of flexible material along an approximate midpoint of the loop. In such embodiments, the grasping tab may be used by an individual to remove the loop of flexible material from within the inner chamber of the container. The grasping tab may also be used by the individual to position the loop of flexible material in one of various use positions around a portion of the individual's body.

The indicia may be positioned along the exterior surface of the loop of flexible material in various places. In some embodiments, the indicia may be positioned to be viewed from the front and back of an individual wearing the apparatus. Other embodiments may position the indicia in a single location along the loop of flexible material. Depending on an intended use of the apparatus, the indicia may be formed using a reflective material to be better viewed in low-light conditions. While it is contemplated that various embodiments will use indicia indicating a law enforcement agency, such as the police, FBI, ATF, and the like, other organizations, such as schools, the military, and various private organizations, are contemplated.

The various embodiments of the apparatus lend themselves to numerous methods of fabrication. In some embodiments, the apparatus is brilliantly colored, which may be used to color coordinate different organizations, such as orange for police and white for school officials. In at least one method of construction, a nylon canvas style material, approximating 4 inches in width and 60 inches in length, is used to construct the loop of flexible material. In some embodiments, a small loop of fabric webbing, approximating one-half inch in width, is attached to the middle of the loop of flexible material to form the grasping tab. In some embodiments, the indicia may be provided in the form of reflective or non-reflective letters or numbers. The indicia may be provided as separate pieces of material that are affixed to the loop of flexible material by stitching, gluing, and the like. In other embodiments, the indicia may be silk-screened onto the flexible material. The indicia may, in some embodiments, be placed on the first exterior surface portion of the loop of flexible material so that the indicia can be read vertically when the apparatus is worn diagonally across the individual's torso. In such embodiments, the indicia may be placed on the loop of flexible material approximately six inches down each side of the loop of flexible material from its center portion, or where it would lie across the individual's shoulder.

In various embodiments, openings may be formed through the free ends of the length of flexible material and secured with grommets. Positioning the free end portions of the length of flexible material adjacent one another will form the "loop" of material. In some embodiments, at least one end portion of the cord may then be passed through the grommets to couple the free ends of the flexible material with one another. The cord may then be coupled with the container. In some embodiments, one end portion of the cord may be secured within the inner chamber of the container.

The container may be provided in various forms. In some embodiments, the container is plastic and shaped to be generally tubular with an open upper end portion and a closed lower end portion. The container may have nearly any desired cross-sectional shape, such as round or square. In some embodiments, the container is formed to be approximately four and a half inches tall and approximately one and an eighth inches in diameter. Various embodiments of the container will include a belt clip affixed to an exterior of the container; the belt clip may be constructed from various materials, including metal or plastic, and shaped to accommodate nearly any intended belt design.

In at least one method of use, the loop of flexible material is rolled or folded into a compact shape and inserted into the container. The container may be enclosed using a cap or other such device to reduce the likelihood that the loop of flexible material will be unintentionally expelled from the container. The individual may then couple the container with a belt, or other article of clothing or clothing accessory, according to the intended use. In some embodiments, the belt may include a holster. In such embodiments, the individual may couple the container with the belt in a location generally opposite the holster to reduce the likelihood of interference with the holster. Once the individual deems it necessary to wear the apparatus, the loop of flexible material is removed from its container. In some embodiments, the loop of flexible material is removed from the container using the grasping tab. In some methods of use, the free end portion of the loop of flexible material is lifted over the individual's head. The individual may then place the individual's head and one shoulder within the loop of flexible material so that the apparatus is disposed in a bandolier fashion, across the individual's chest and back. Other final positions for the loop of flexible material are contemplated, including transversely or longitudinally disposed with respect to the individual's body.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
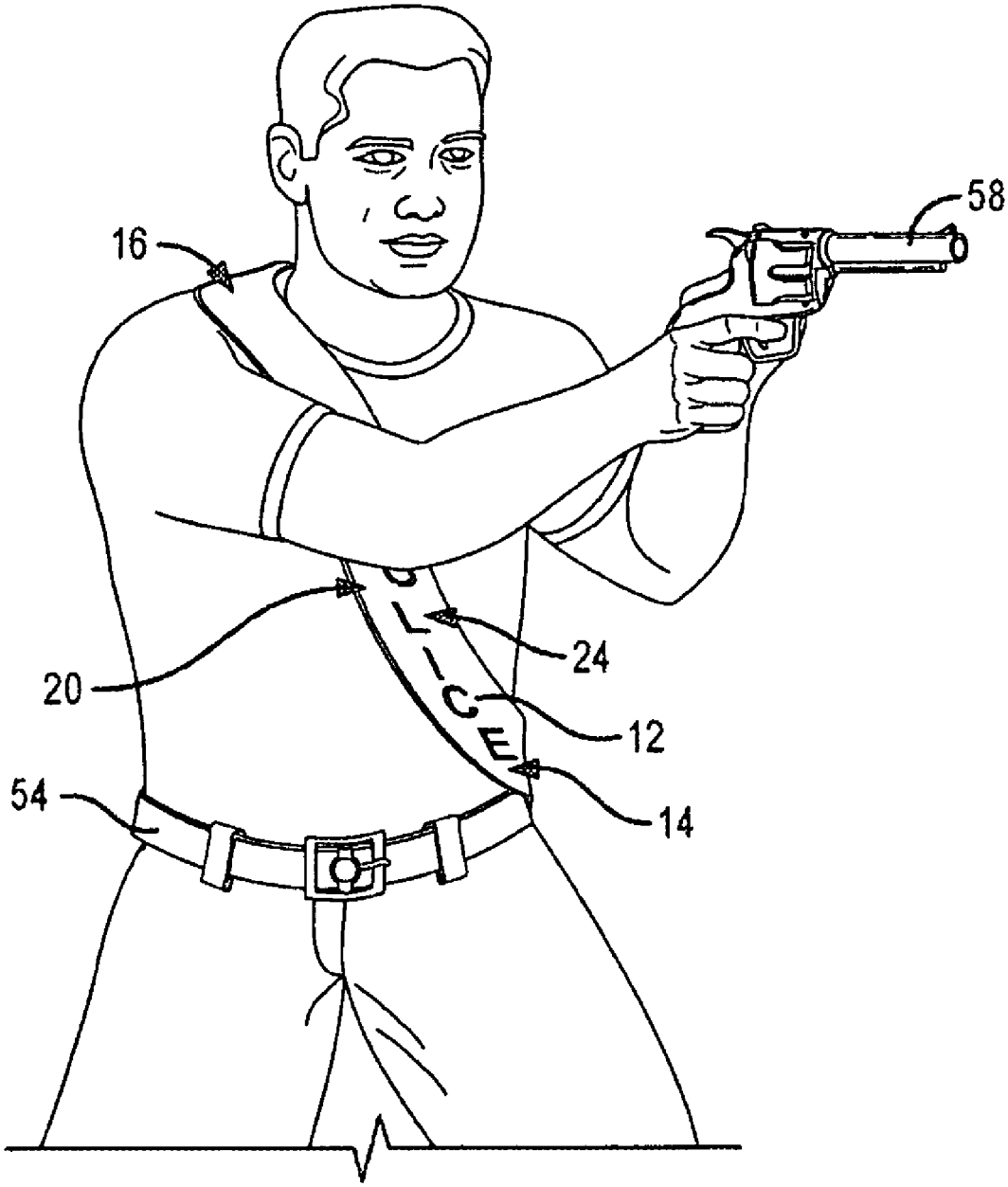
FIG. 1 depicts a front elevation view of an individual demonstrating one method of using an embodiment of the identification apparatus.
Figure 2:
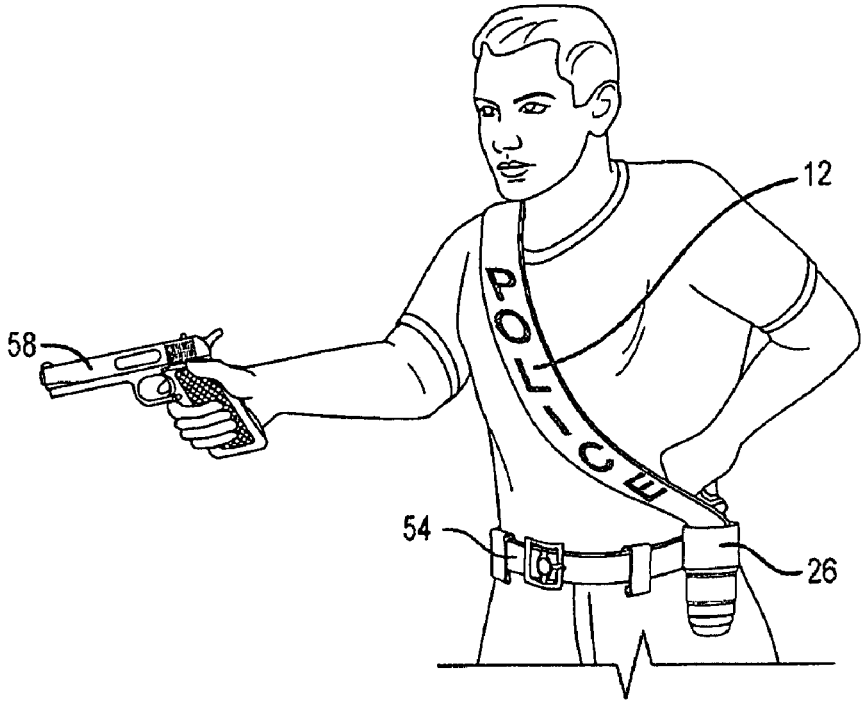
FIG. 2 depicts a side elevation view of the individual depicted in FIG. 1 as the individual enters a firing position with a pistol while wearing an embodiment of the identification apparatus.
Figure 2A:
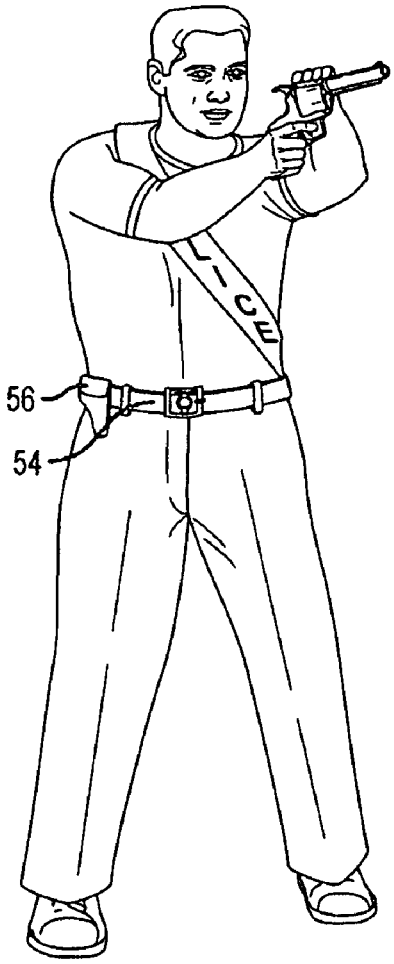
FIG. 2A depicts a front elevation view of the individual depicted in FIG. 2 after the individual attains a firing position while wearing an embodiment of the identification apparatus.
Figure 3:
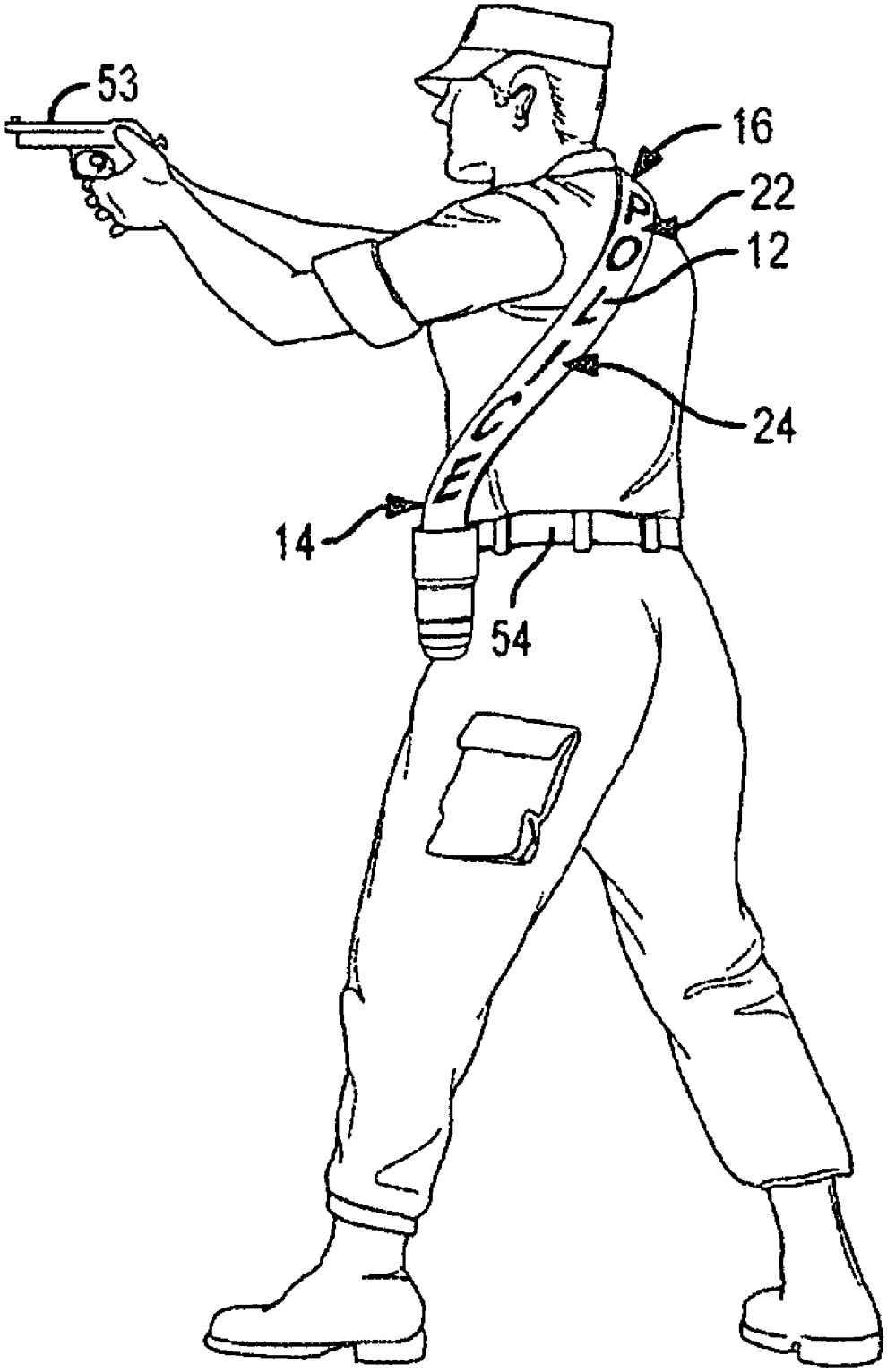
FIG. 3 depicts a rear elevation view of the individual depicted in FIG. 2A.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

In various embodiments, the identification apparatus may be provided with a loop of flexible material 12 having a first end portion 14 and a second end portion 16. The loop of flexible material 12 will have an outwardly faced exterior surface 18 that is defined, at least partially, by a first exterior surface portion 20 and a second exterior surface portion 22. While it is contemplated that the nature of the loop of flexible material 12 will permit the material to be disposed in a wide variety of shapes, it is contemplated that these various shapes will position the first exterior surface portion 20 and the second exterior surface portion 22 so that they face in generally opposite directions when the apparatus 10 is in use.

In various embodiments of the apparatus 10, indicia 24 will be displayed on at least one of the first exterior surface portion 20 or the second exterior surface portion 22. In some embodiments, the indicia 24 will be displayed from both portions of the exterior surface 18. In many embodiments, the indicia 24 will identify an individual using the apparatus 10 as a member of an organization. As such, the indicia 24 may be provided in the form of letters, numbers, symbols or any combination thereof. Some specific, but nonlimiting, examples include "police", "FBI", and "ATF". While these examples are all representative of law enforcement organizations, it is contemplated that the indicia 24 may relate to other organizations, such as schools, private and governmental agencies, and the like. Irrespective of the specific type of indicia displayed on the loop of flexible material 12, the positioning of the indicia 24 may vary. In many embodiments, the positioning of the indicia 24 will depend upon the manner in which the loop of flexible material 12 is used. For example, where the loop of flexible material 12 is presented in a vertical fashion, the indicia may be displayed to extend from the first end portion 14 to the second end portion 16 at the loop of flexible material 12 in a horizontal manner. The indicia 24 may further extend in the same direction but in an orientation that is generally perpendicular to the loop of flexible material.

In some embodiments, the apparatus 10 may be provided with a container 26, having an opening 28 that is in communication with an inner chamber 30. It is contemplated that the container 26 may be formed from a wide array of suitable materials that include metal, plastic, and the like. The container 26 may be fabricated to produce a wide array of shapes as well. For example, the container 26 may be provided in a cylindrical fashion, having a generally circular or ovular cross section. Other shapes may provide a cross sectional shape resembling a square, or other polygon that is desired according to the intended appearance and use of the apparatus 10. In some embodiments, a lid 32 may be operatively coupled with the container 26, adjacent the opening 28. In some embodiments, the connection between the lid 32 and the container 26 may be provided with a hinge 34, which may take the form of a separate hinge structure or a living hinge that is integrally formed with the container 26 and the lid 32. While the size and shape of the container 26 may vary greatly, the inner chamber 30 may be sized to receive at least a substantial portion of the loop of flexible material 12. In this manner, the container 26 may serve as a storage vessel for the loop of flexible material 12. Accordingly, in some embodiments, the container 26 will have a generally elongated nature to better accommodate the loop of flexible material 12 and retain a minimal profile.

In some embodiments, at least one end portion of the loop of flexible material 12 will be operatively coupled with the container 26. In some embodiments, a length of flexible cord 36, having opposite end portions 38 and 40, will couple the length of flexible material 12 with the container 26. In at least one embodiment, the loop of flexible material may be generally formed by positioning a first free end portion 42 of the loop of flexible material 12 closely adjacent a second free end portion 44. Openings 46 may be formed to penetrate the end portions of the loop of flexible material. In some embodiments, the openings 46 may be secured with grommets of various suitable materials that include metal, plastic, and the like. In such embodiments, at least one end portion of the length of cord 36 may be passed through the openings 46. An opposite end portion of the cord 36 may then be coupled with the container 26. In at least one embodiment, the cord 36 may be secured, at least partially, within the inner chamber 30 of the container 26. In one embodiment, an opening is formed through the container 26 at a lower end portion thereof. A portion of the cord 36 is passed into the inner chamber 30 of the container 26 and out the opening at the lower end portion of the container 26. The free end portion of the cord 36 that has passed through the container may be secured in a knot or to another structure that may serve as a stop for preventing the unintentional withdrawal of the cord from the container 26. Other contemplated embodiments may couple one end portion of the cord 26 with the lid 32, the hinge 34, or about the exterior surface of the container 26 in some manner. To that end, an eyelet or other such structure may be provided along the exterior surface of the container 26 to which the cord 36 may be secured.

The loop of flexible material 12 defines an open interior portion 48. As will be described in greater detail below, the open interior portion 48 may be used to secure the loop of flexible material 12 around one or more portions of an individual's body. As such, it is contemplated that the first end portion 14 of the loop of flexible material 12 may be provided in an expandable fashion. In such embodiments, the first free end portion 42 and second free end portion 44 of the loop of flexible material 12 will be loosely secured to one another using the cord 36, which will simply pass through the openings 46 formed through the end portions of the loop of flexible material 12. It is contemplated, however, that where a more secure loop is desired, the first free end portion 42 and second free end portion 44 may be tightly secured with one another using one end portion of the cord 36. In some embodiments, the cord 36 may be formed using a deformably resilient material, such as bungee cord. In such embodiments, the cord 36 will provide an individual with the ability to firmly pull the loop of flexible material 12 away from the container 26 a greater distance than if the cord 36 were static in nature. Moreover, the use of a deformably resilient material will enable the individual to position the loop of flexible material 12 around a portion of the individual's body and attain a snug fit due to the resilient nature of the cord 36 and its natural tendency to pull back toward the container 26.

To the extent that the loop of flexible material 12 is temporarily stored within the inner chamber 30 of the container 26, some embodiments may associate a grasping tab 50 with the loop of flexible material 12, providing a structure that may be easily located by the individual for grasping and removing the loop of flexible material 12 from the container 26. In some embodiments, the grasping tab 50 may be provided in the form of a small loop of fabric that is attached to an approximate mid-portion of the loop of flexible material 12. The grasping tab 50 may be provided in a generally elongated fashion to extend outwardly from the exterior surface 18 or a peripheral edge portion of the loop of flexible material 12. In various embodiments, however, the grasping tab 50 will be positioned in a location that provides an individual with easy access to the grasping tab 50 when removing the loop of flexible material 12 from the container 26. Moreover, the position of the grasping tab 50 along the loop of flexible material 12 should be provided such that an individual may easily use the grasping tab 50 to manipulate the loop of flexible material 12 in various positions with respect to the individual's body. This will help the individual to move the loop of flexible material 12 into and out of various use positions.

Various methods of constructing the apparatus 10 are contemplated. In some embodiments, the material used to fabricate the loop of flexible material 12 may be of various known, durable materials. Some materials, such as a nylon-canvas type of material, may provide a rugged, weather resistant nature when desired. The material used may be provided in a wide array of various colors. Certain colors, such as hunter-orange, yellow, and white may be more noticeable in various light conditions and environments than other colors, such as black, navy blue, and the like. In some embodiments, the color selected for the loop of flexible material 12 may serve as part of the indicia 24 that identifies a particular organization. For example, in some embodiments, the color orange may be used to indicate a police organization, whereas white may be used by school officials. A nearly infinite combination of such color codes may be used according to the circumstances presented and the number of different organizations that may be separately identified from one another.

Figure 4:
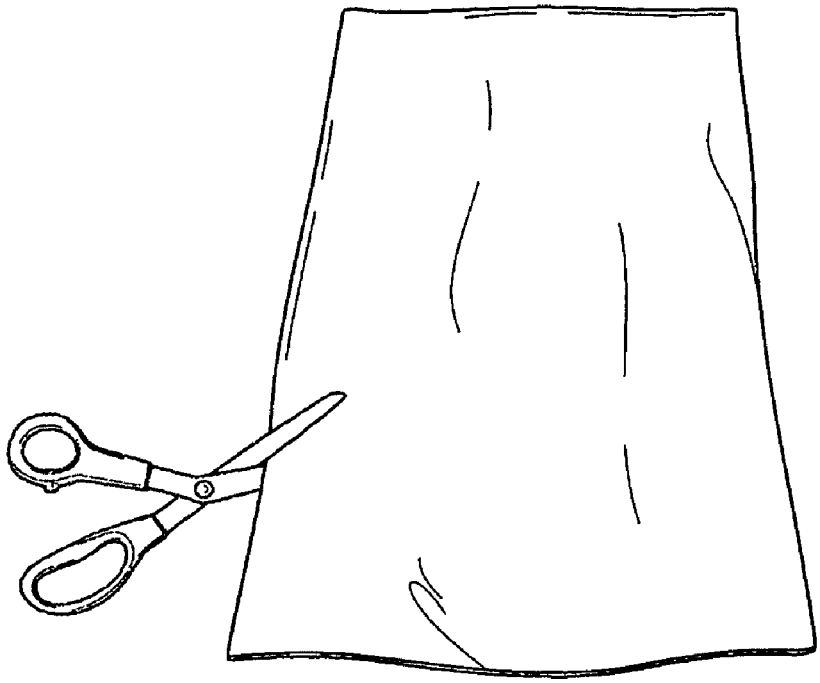
FIG. 4 depicts a perspective view of material that may be shaped for use in fabricating the loop of flexible material.
Figure 5:
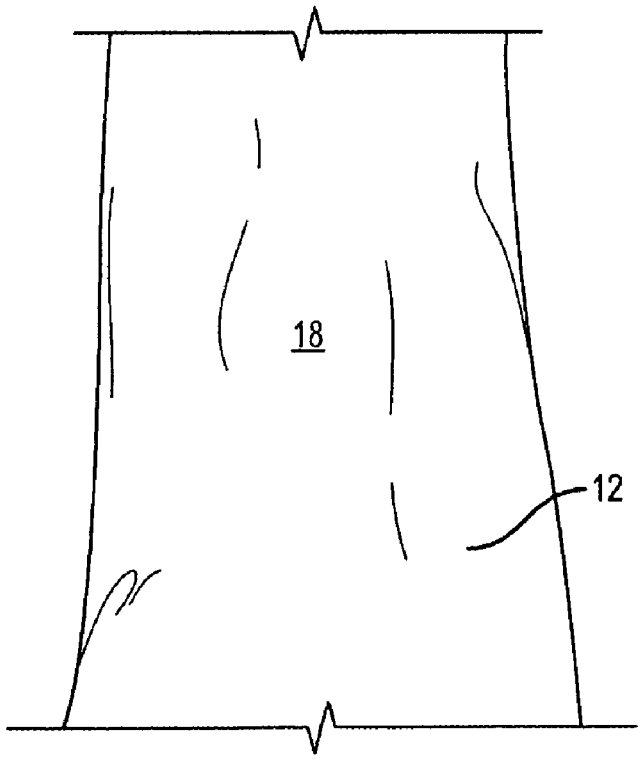
FIG. 5 depicts a top plan view of the material depicted in FIG. 4 after an initial shaping of the material.
Figure 6:
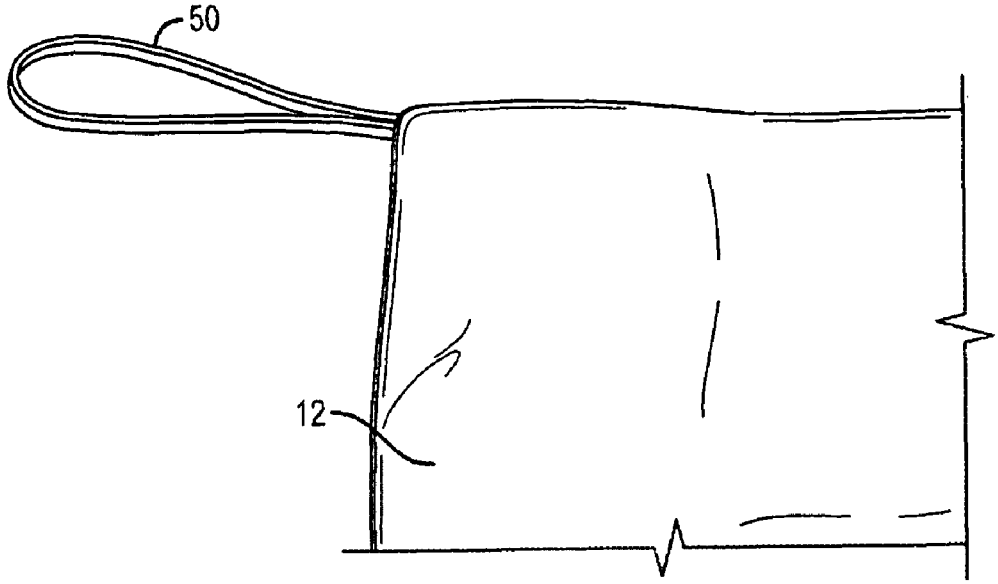
FIG. 6 depicts an isometric view of one embodiment of the grasping tab and one manner in which it may be coupled with the loop of flexible material.
Figure 7:
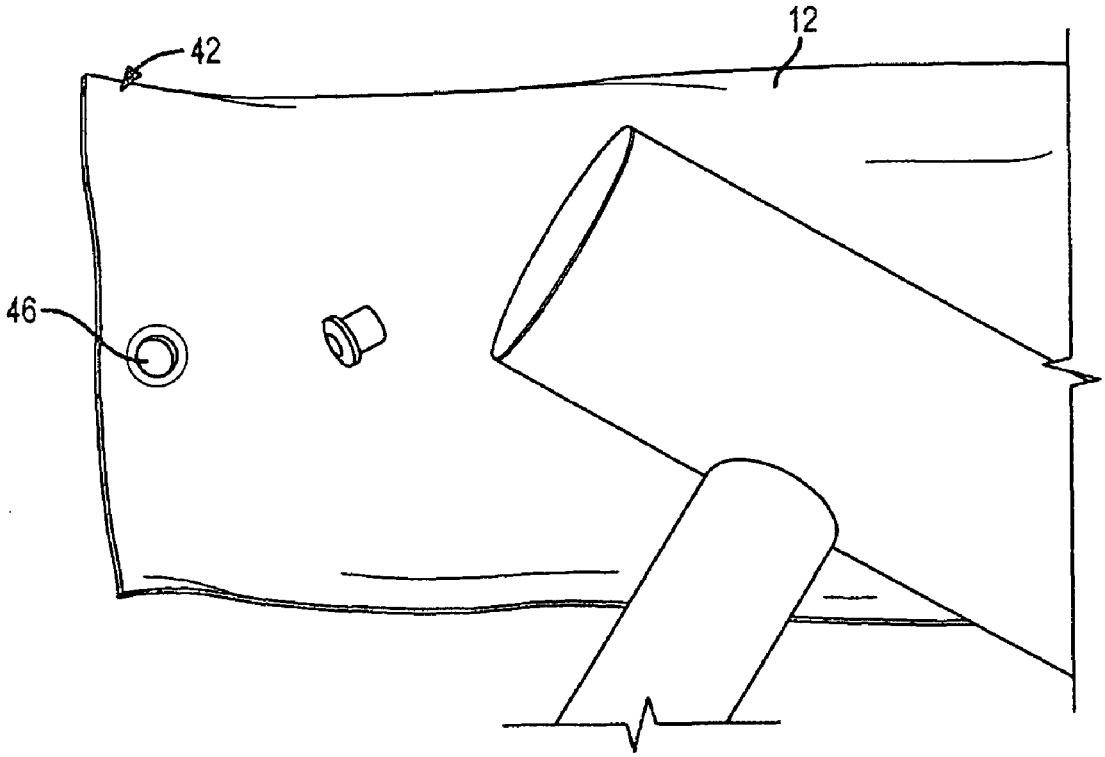
FIG. 7 depicts an isometric view of a free end portion of the loop of flexible material and demonstrates one method of coupling a grommet with an opening formed through the material.
Figure 8:
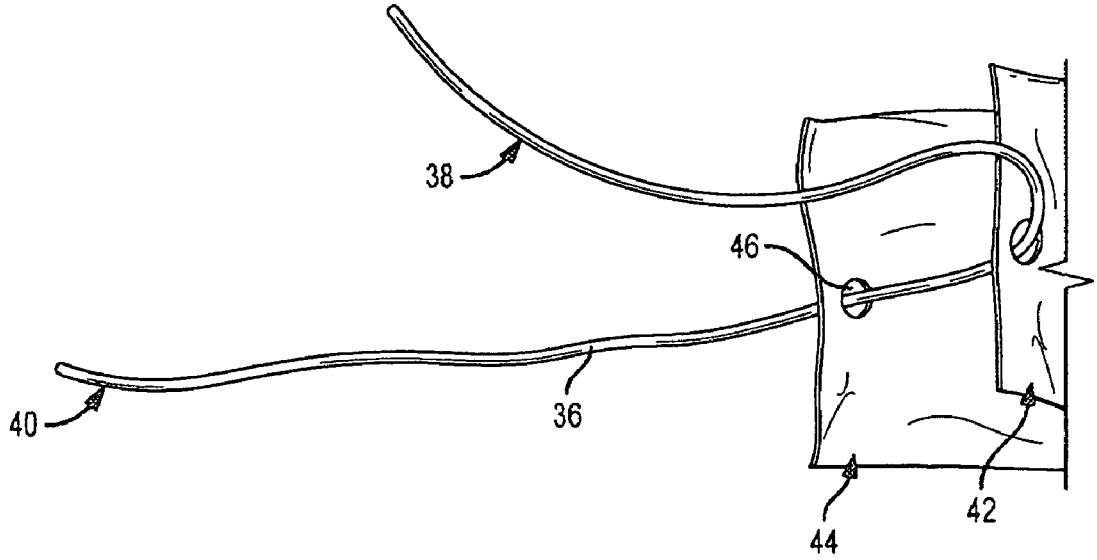
FIG. 8 depicts an isometric view of one end portion of the loop of flexible material and demonstrates one manner in which a cord may be coupled with the end portion, through a pair of opposing openings formed in the free end portions of the loop of flexible material.
Figure 9:
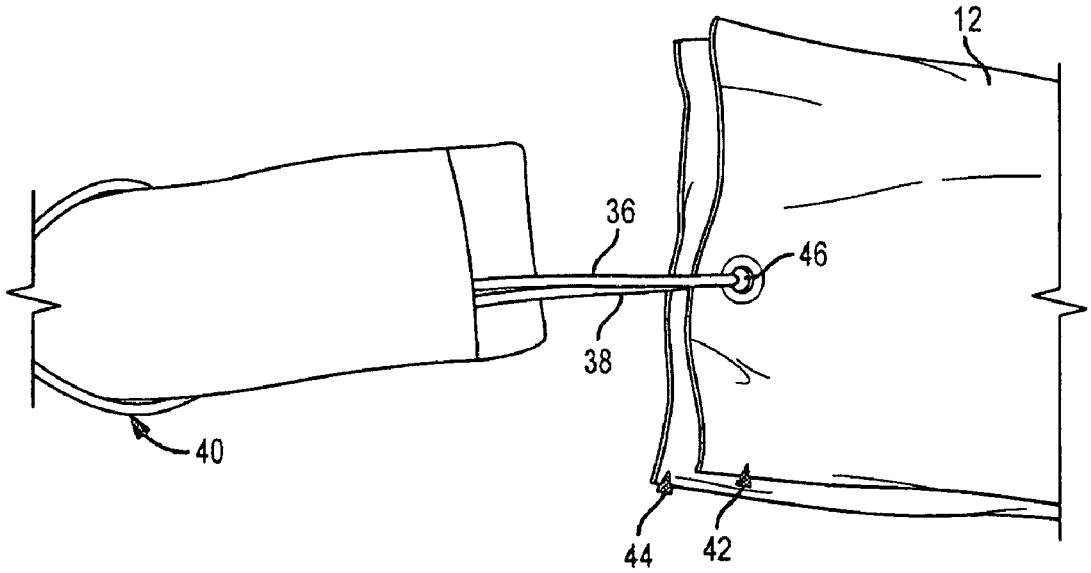
FIG. 9 depicts a top plan view of a portion of the apparatus and demonstrates one manner in which one end portion of the cord may be coupled with the loop of flexible material and an opposite end portion of the cord may be coupled with a container, securing the container with the loop of flexible material.
Figure 10:
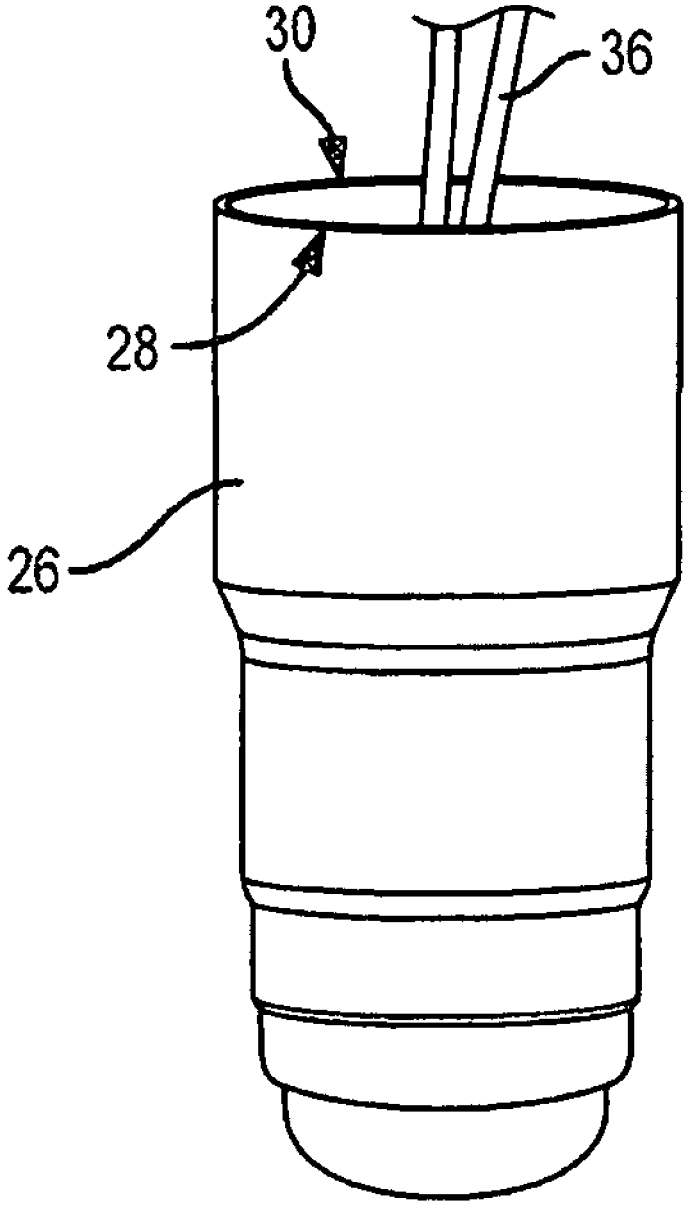
FIG. 10 depicts a side elevation view of one embodiment of a container that may be used with the apparatus.
Figure 11:
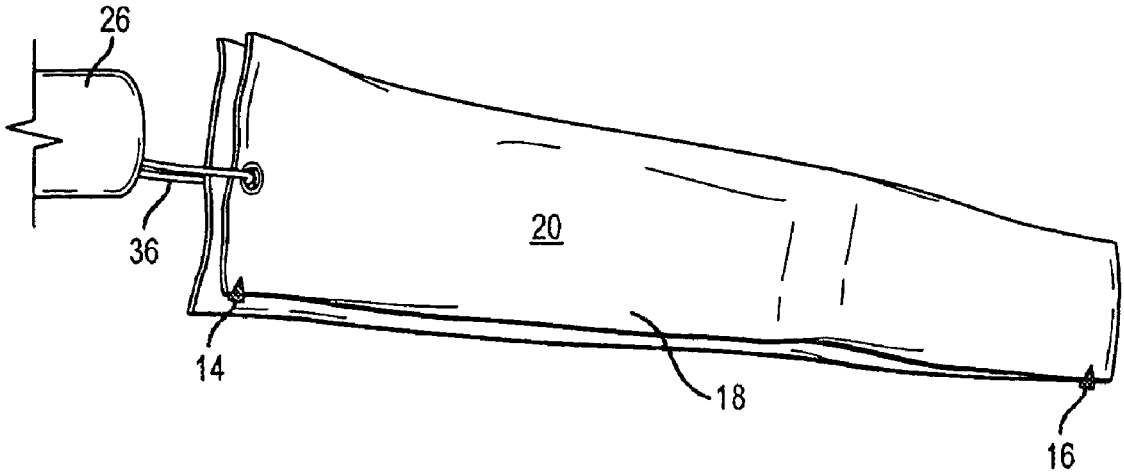
FIG. 11 depicts a top plan view of one embodiment of the apparatus and demonstrates one manner in which the loop of flexible material may be laid out on a level surface prior to storing the loop of flexible material within the container.
Figure 12:
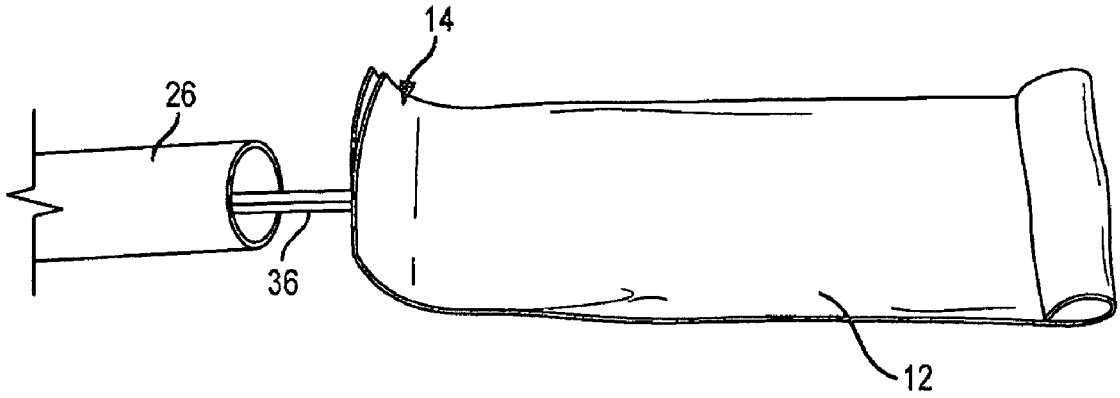
FIG. 12 depicts a top plan view of the apparatus depicted in FIG. 11 and demonstrates one manner in which the loop of flexible material may be rolled into a compact shape prior to storing the loop of flexible material within the container.

With reference to FIGS. 4 and 5, the materials selected may be cut into a generally elongated shape, such as a rectangle, ellipse, oval, or the like. In some embodiments, a rectangle is fashioned with dimensions approximating four inches in width and sixty inches in length. The grasping tab 50 may then be secured with the length of material. In various embodiments, the grasping tab 50 may be attached to an approximate midpoint of the sixty inch length of the material. The grasping tab 50 may be an elongated piece of fabric or may also be folded upon itself to form a small loop. In either regard, the grasping tab 50 may be secured to the exterior surface 18 of the loop of flexible material 12 or a peripheral edge portion thereof, such as depicted in FIG. 6.

The indicia 24 may be displayed along the exterior surface 18 of the loop of flexible material 12 in a variety of embodiments. In one example, the indicia 24 may be provided in the form of letters, numbers, or symbols that are formed from separate pieces of material. These indicia 24 may then be secured with the loop of flexible material 12 using adhesives, stitching, and other known methods of affixing separate pieces of material to one another. In other embodiments, the indicia 24 may be silk-screened or painted onto the loop of flexible material 12. It is contemplated that the materials used to fabricate the indicia 24 may be reflective in nature. In these embodiments, the reflective indicia 24 will provide a greater degree of relative visibility in low light situations. In some embodiments, the indicia 24 may be displayed from the first exterior surface portion 20 and the second exterior surface portion 22 of the loop of flexible material 12. However, it is contemplated that the indicia 24 may be displayed from only a single discreet area of the exterior surface 18. In at least one embodiment, the indicia 24 are positioned so that they may be read vertically along a length of the loop of flexible material 12. In such an embodiment, the indicia 24 are placed on the loop of flexible material 12 approximately 6 inches down each side from an approximate midpoint of the loop of flexible material 12.

With the loop of flexible material 12 formed, it may be coupled with the container 26. In some embodiments, a 12 inch length of bungee cord 36, having a diameter approximating a shoe lace, is passed through openings 46 that penetrate one end portion of the loop of flexible material 12. At least one end portion of the cord 36 may be coupled with a portion of the container 26 as described previously.

Where the loop of flexible material 12 is provided in dimensions approximating those provided in the example hereinabove, the container 26 may be provided in the shape of an elongated cylinder that approximates four and a half inches in length and approximately one and an eighth inches in diameter. However, it is contemplated that a wide range of dimensions may be provided to accommodate various sizes and shapes of the loop of flexible material 12. Moreover, the intended conditions in which the apparatus 10 is to be used may dictate the size and shape of the container 26. In a number of embodiments, however, a belt clip 52 may be associated with the container 26. In some embodiments, the clip may be provided in the form of a generally resilient tongue that extends along a rear surface of the container 26. In other embodiments, the belt clip 52 may be provided in the form of one or more loops or elongated openings through which a belt 54 may be passed. It is contemplated that the container 26 may be secured with the belt 54 or other articles of clothing or clothing accessories. In one example, the container 26 may be coupled with a pocket or an upper edge portion of a pair of pants. In other embodiments, the container 26 may be coupled with a pocket or other portion of a jacket.

It is contemplated that the loop of flexible material 12 may be provided in various shapes to accommodate various intended uses. In some embodiments, the loop of flexible material 12 may be formed from a section of material that is approximately six inches in width and sixty inches in length with a head slot cut through an approximate mid-portion of the length of material. In such an embodiment, the loop of flexible material 12 may be stored in a wallet style container 26 that would be removably coupled with a belt 54 or other such article of clothing or clothing accessory. In these contemplated embodiments, the loop of flexible material 12 may be rolled or folded upon itself and stored within the container 26 until it is needed for use. When deployed, the loop of flexible material 12 in these embodiments may be positioned over the head of an individual, who passes his or her head through the head slot. In this manner, the loop of flexible material 12 is worn by the individual much like a poncho. End portions of the length of material may then be tucked into a waistband at the front and back of the individual or may be left to hang free.

Figure 13:
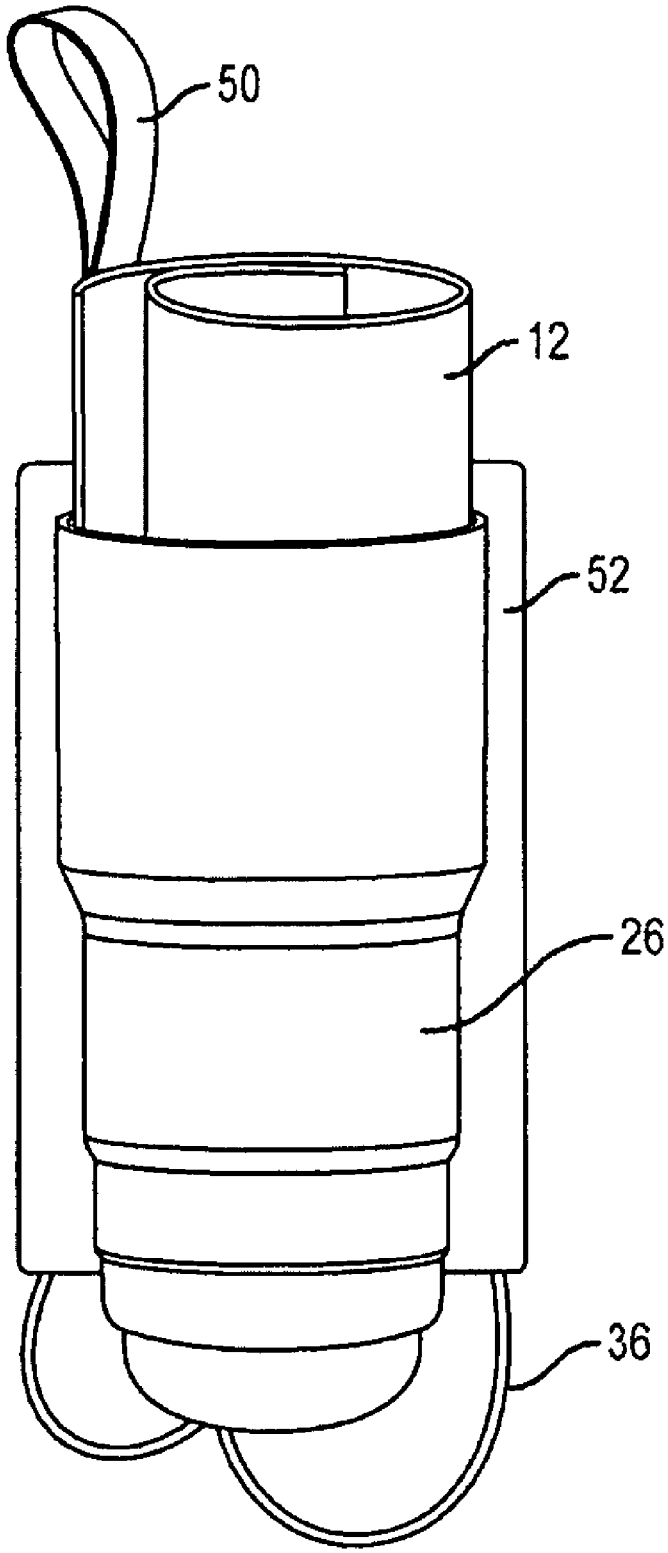
FIG. 13 depicts a side elevation view of one embodiment of the apparatus and depicts one manner in which the loop of flexible material may be inserted in the inner chamber of the container for storage.
Figure 14:
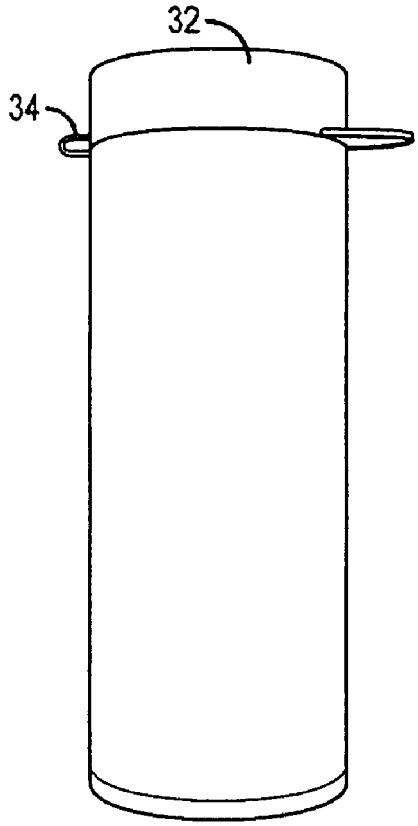
FIG. 14 depicts a side elevation view of one embodiment of the container as it may be provided with a cap and demonstrating the cap in a closed position.
Figure 15:
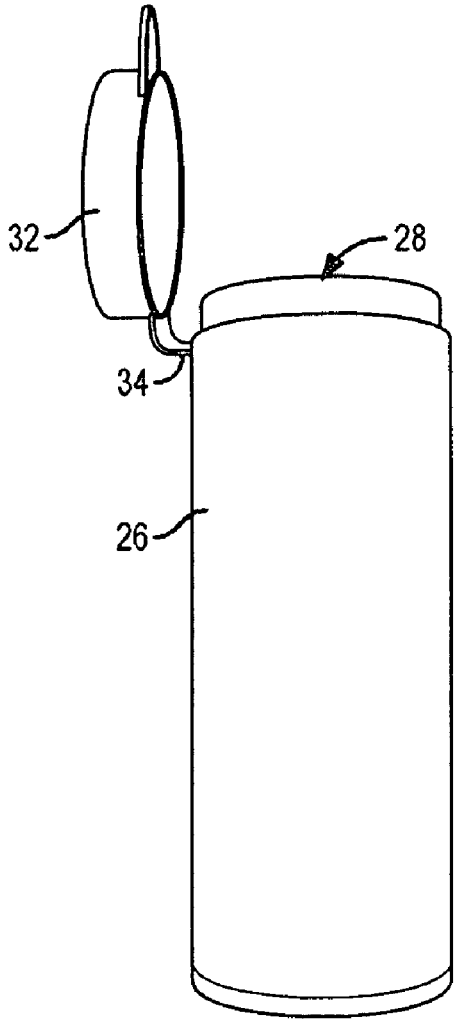
FIG. 15 depicts the container depicted in FIG. 14 and demonstrates the cap in an open position.
Figure 16:
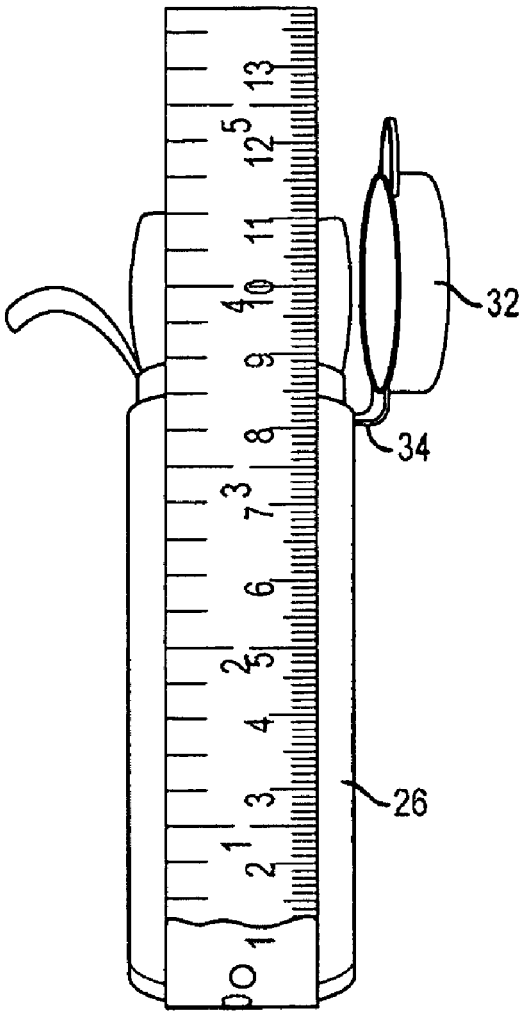
FIG. 16 depicts a side elevation view of one embodiment of the apparatus and presents the apparatus adjacent a measuring tape for perspective as to contemplated dimensions.
Figure 17:
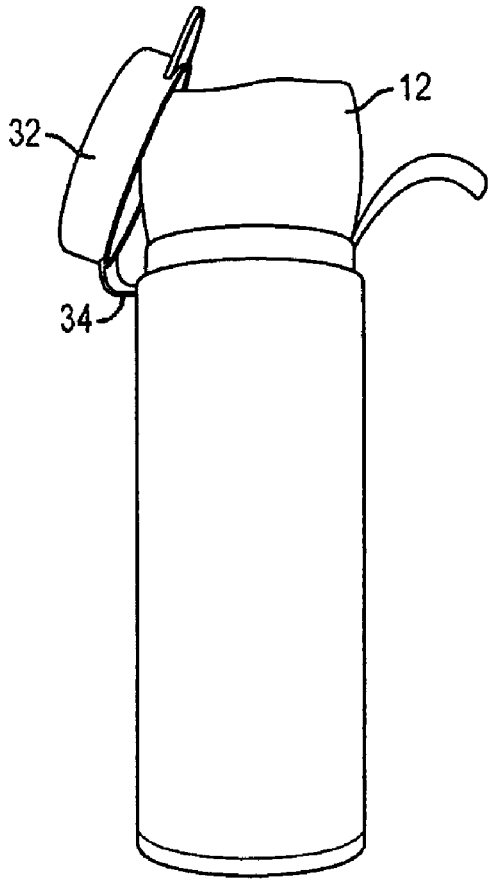
FIG. 17 depicts a side elevation view of one embodiment of the apparatus and shows the loop of flexible material, partially removed from within the inner chamber of the container.

The apparatus 10 may be used in a variety of different ways to adequately identify an individual to those in the individual's environment. In some embodiments, the loop of flexible material 12 may be rolled or neatly folded accordion style into a compact shape. With reference to FIG. 13, a loop of flexible material 12 may then be substantially disposed within the inner chamber 30 of the container 26. In some embodiments, the loop of flexible material 12 may be fully disposed within the inner chamber 30 in order to permit the individual to close a lid 32 and securely retain the loop of flexible material 12 within the container 26. In various embodiments, the container 26 may then be coupled with the belt 54 of an individual or other clothing accessory or article of clothing as the individual deems appropriate. In at least one embodiment, the belt 54 is provided with a holster 56 that is located at one end portion of the belt 54. In at least one embodiment, the container 26 may be coupled with an opposite end portion (or off-hand side) of the belt 54 using the belt clip 52.

Figure 18:
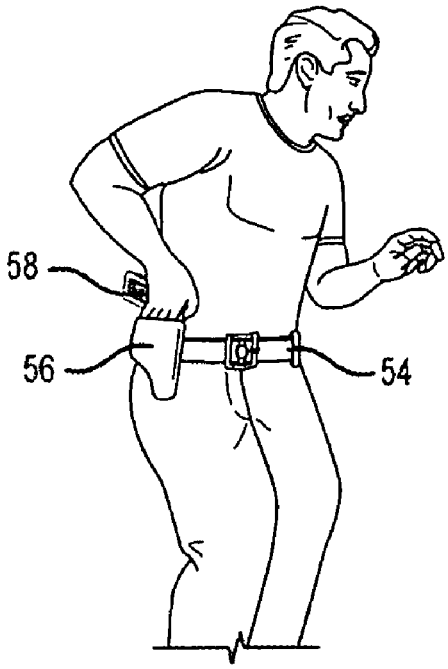
FIG. 18 depicts a side elevation view of a law enforcement officer in position to withdraw a weapon from a holster coupled with his belt.
Figure 19:
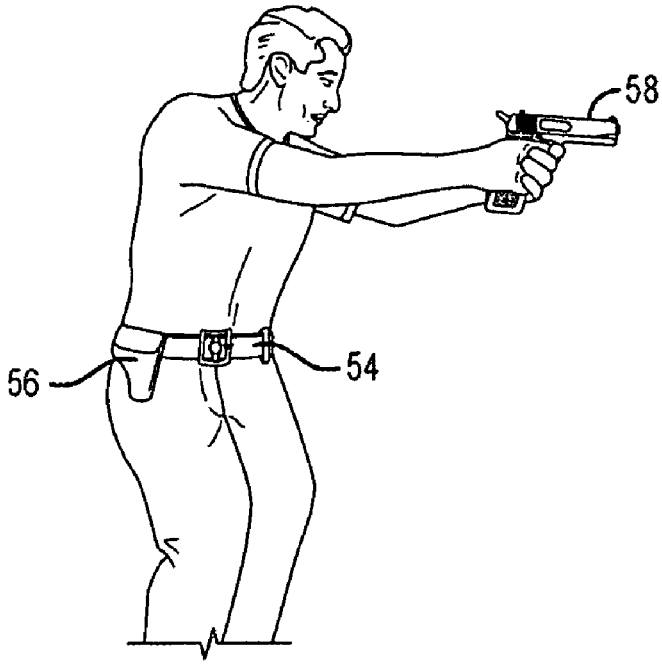
FIG. 19 depicts a side elevation view of the law enforcement officer depicted in FIG. 18 as the officer has drawn his weapon and taken a firing position with the weapon.
Figure 20:
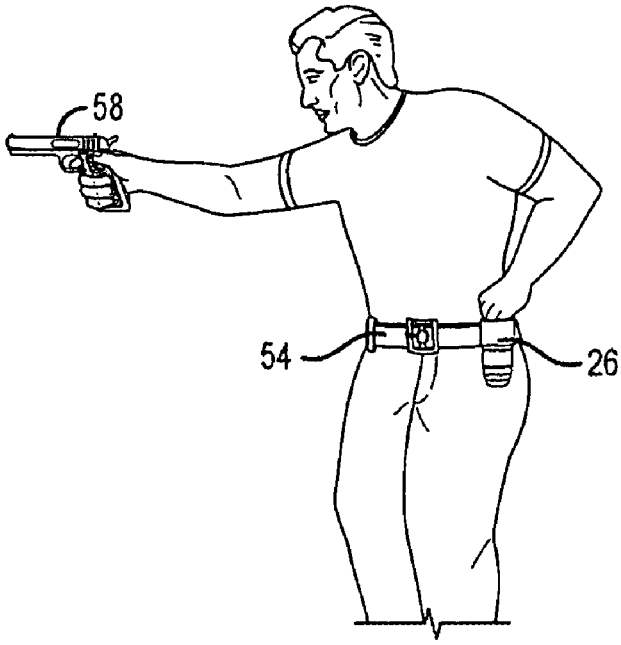
FIG. 20 depicts a side elevation view of the law enforcement officer depicted in FIG. 19 as the officer uses his off-hand to open the container and grasp the loop of flexible material.
Figure 21:
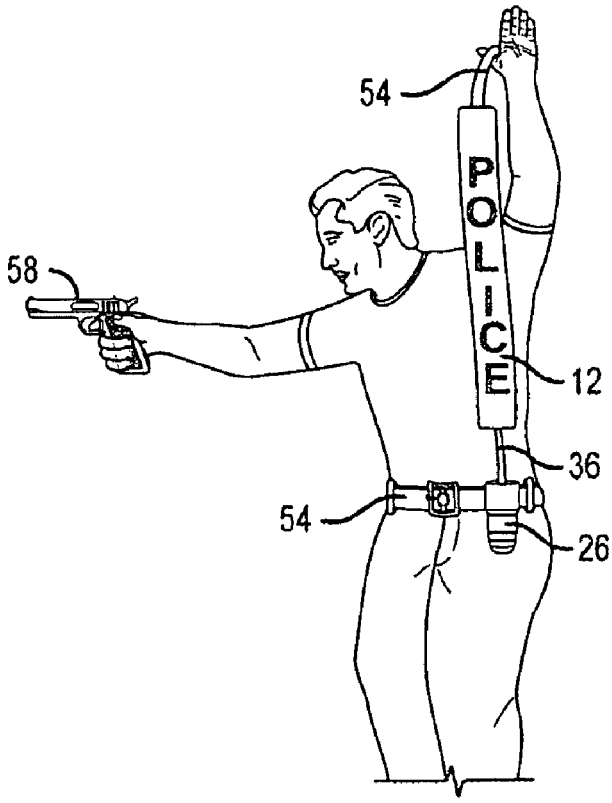
FIG. 21 depicts a side elevation view of the law enforcement officer depicted in FIG. 20 as the officer uses his off-hand to grasp the loop of flexible material and withdraw it from the inner chamber of the container, moving it to an elevated position.
Figure 22:
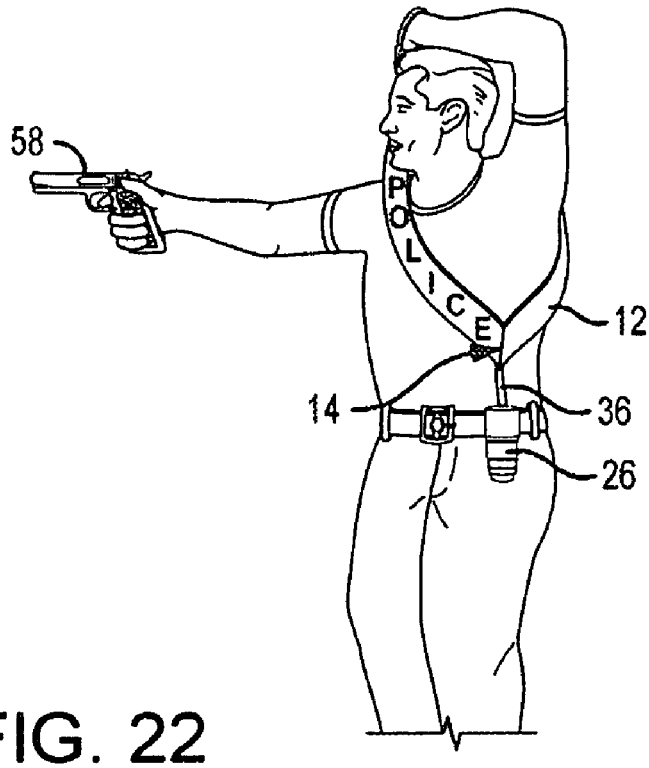
FIG. 22 depicts a side elevation view of the law enforcement officer depicted in FIG. 21 as the officer uses his off-hand to position his head and off-hand shoulder within the loop of flexible material.
Figure 23:
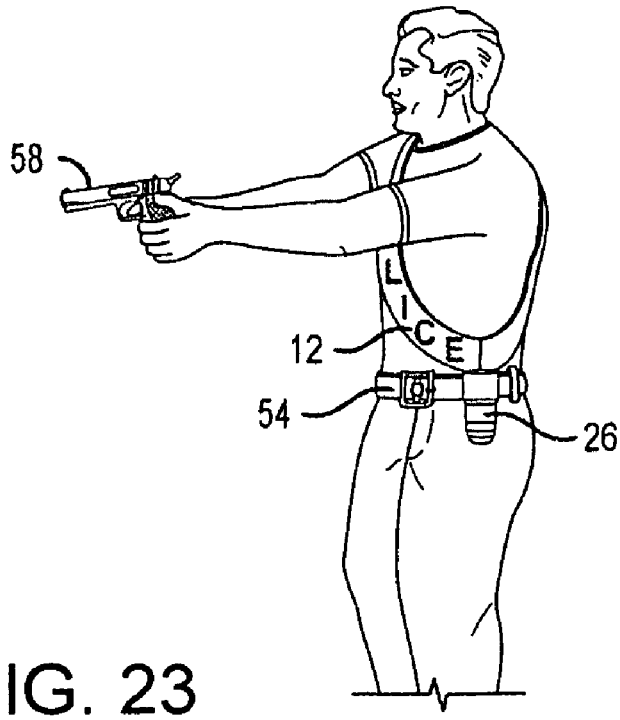
FIG. 23 depicts a side elevation view of the law enforcement officer depicted in FIG. 22 as the officer resumes a firing position with his weapon with the apparatus displayed in one contemplated embodiment.
Figure 24:
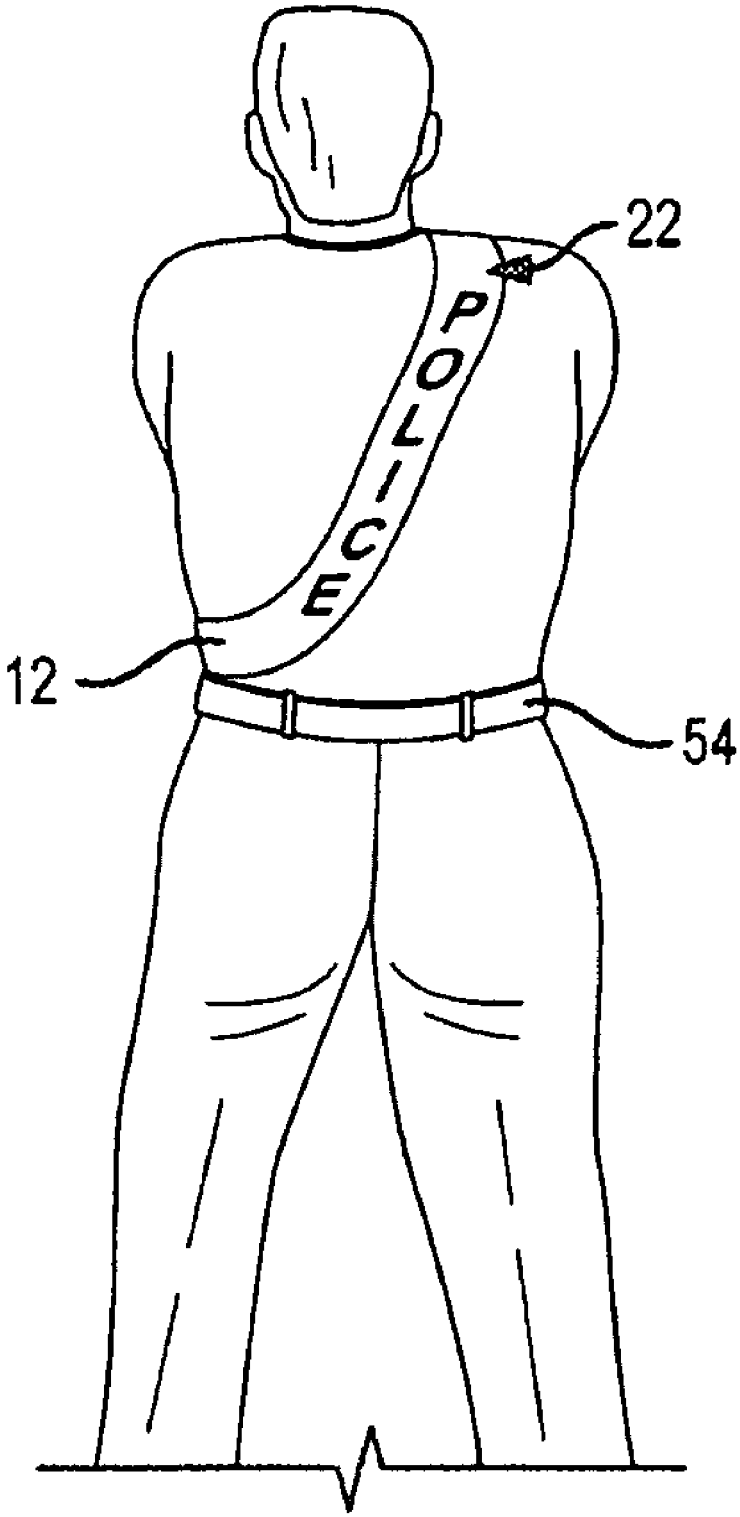
FIG. 24 depicts a rear elevation view of the law enforcement officer depicted in FIG. 23.
Figure 25:
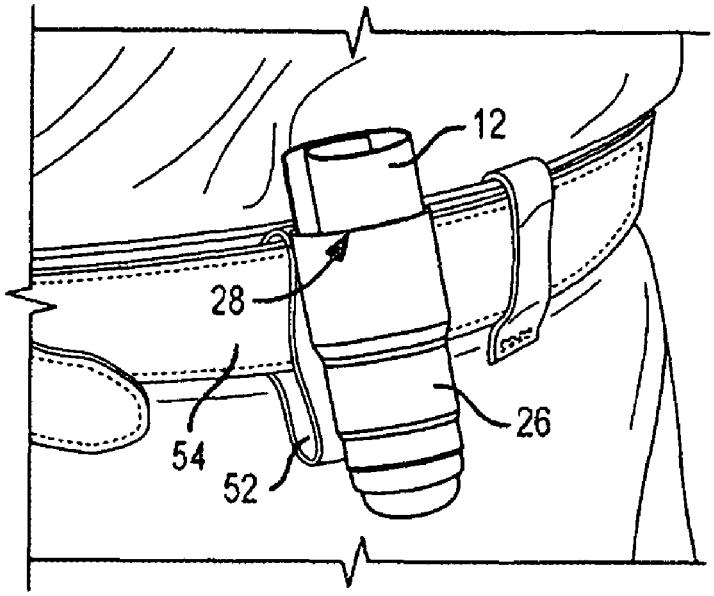
FIG. 25 depicts a side elevation view of the apparatus and demonstrates one manner in which it may be coupled with the belt of an individual with the loop of flexible material partially removed from the inner chamber of the container.
Figure 26:
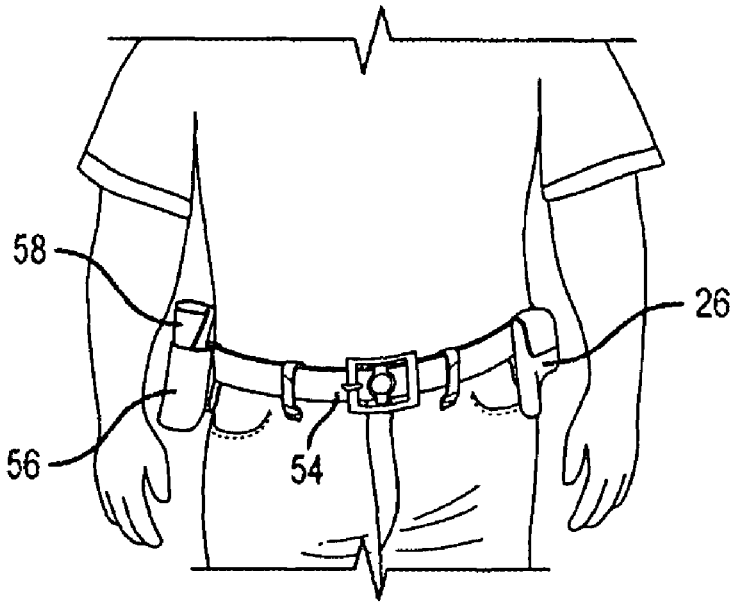
FIG. 26 depicts a partial, front elevation view of the law enforcement officer depicted in FIG. 18 as the officer stands in a relaxed position with his weapon holstered and the apparatus coupled with the off-hand side of the belt.

With reference to FIGS. 18-24, the apparatus 10 may be used in situations demanding the individual's full attention and the use of firearms, simultaneously. FIG. 18 depicts an exemplary situation where a law enforcement officer is confronted with a situation demanding that the officer's weapon be withdrawn from the holster 56, using the officer's gun hand. FIG. 19 depicts the officer in a firing position with a pistol 58. With a suspect being covered with the pistol 58, it may be desirable for the officer to properly identify himself to the suspect and others in the surrounding environment. Accordingly, FIG. 20 depicts one embodiment whereby the officer grasps the apparatus 10 with the officer's off-hand. Where appropriate, the officer may first open a lid 32 to expose the grasping tab 50. The officer may then grab the grasping tab 50 and extract the loop of flexible material 12 from the inner chamber 30 of the container 26, supporting the loop of flexible material 12 in an extended position away from the container 26, such as depicted in FIG. 21. In some embodiments, the officer may then extend the loop of flexible material 12 over the officer's off-hand shoulder and head, such as depicted in FIG. 22. With reference to FIG. 23, the officer has successfully positioned the loop of flexible 22 in a bandolier-style position diagonally across the officer's chest and back area. With the loop of flexible material 12 in position, extending from the gun-hand shoulder down toward the off-hand hip, the officer may resume a firing position with the pistol 58 using both hands. FIG. 24 depicts one embodiment of the apparatus 10 and how the loop of flexible material 12 may be positioned across the back of the officer in the aforedescribed position.

It is contemplated that the loop of flexible material 12 may be positioned in a multitude of different positions with respect to the individual's body. For example, one contemplated position couples the second end portion 16 of the loop of flexible material 12 about the individual's arm and shoulder, whereas the first end portion 14 is positioned directly beneath the shoulder, adjacent the individual's hip. In this manner, the loop of flexible material 12 is positioned in a generally vertical fashion. It is further contemplated that another position may dispose the loop of flexible material 12 around the individual's chest or waist. In this fashion, the loop of flexible material 12 may be displayed in a generally horizontal fashion. Other such relative positions with respect to the individual's body in diagonal, horizontal, and vertical positions are contemplated.

Although the system 10 has been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An apparatus for identifying an individual: the apparatus comprising:

a loop of flexible material having (i) first and second opposite end portions, and (ii) an outwardly faced exterior surface that is defined by at least a first exterior surface portion and a second exterior surface portion; said first exterior surface portion and said second exterior surface portion being oriented to face in generally opposite directions;

indicia (i) displayed on at least the first exterior surface portion of said loop of flexible material and (ii) identifying the individual as a member of an organization; and a container having an opening in communication with an inner chamber; said inner chamber being sized to receive at least a substantial portion of said loop of flexible material:

a length of flexible cord having opposite end portions; one end portion of said cord being connected with said container and an opposite end portion of said cord being connected with the first end portion of said loop of flexible material, the first end portion of said loop of flexible material being formed from two free ends of said loop of flexible material; the free ends of said loop of flexible material each having an opening penetrating the free ends of said loop of flexible material; at least a portion of said cord (i) extending, through the openings in the free ends of said loop of flexible material and (ii) coupling the free ends with one another.

2. The apparatus of claim 1 wherein:

said length of cord is comprised of an elastic material.

3. The apparatus of claim 1 wherein:

at least one end portion of said cord is secured within the inner chamber of said container.

4. The apparatus of claim 1 further comprising:

a grasping tab extending outwardly from the exterior surface of said loop of flexible material, adjacent a second end portion of said loop of flexible material.

5. The apparatus of claim 1 wherein:

said indicia are comprised of a reflective material.

6. The apparatus of claim 1 wherein:

said indicia include letters that identify the individual as a member of a law enforcement organization.

7. The apparatus of claim 6 wherein:

said indicia is displayed on the first exterior surface portion and the second exterior surface portion of said loop of flexible material.

8. A method for identifying an individual as a member of an organization, the method comprising:

providing an identification apparatus comprising:

a loop of flexible material having (i) first and second opposite end portions, and (ii) an outwardly faced exterior surface that is defined by at least a first exterior surface portion and a second exterior surface portion; said first exterior surface portion and said second exterior surface portion being oriented to face in generally opposite directions;

indicia (i) displayed on at least the first exterior surface portion of said loop of flexible material and (ii) identifying the individual as a member of an organization; and a container having an opening in communication with an inner chamber:

a length of flexible cord having opposite end portions; one end portion of said cord being connected with said container and an opposite end portion of said cord being connected with the first end portion of said loop of flexible material; at least a substantial portion of said loop of flexible material being disposed within the inner chamber of said container; the first end portion of said loop of flexible material being formed from two free ends of said loop of flexible material: the free ends of said loop of flexible material each having an opening penetrating the free ends of said loop of flexible material: at least a portion of said cord (i) extending through the openings in the free ends of said loop of flexible material and (ii) coupling the free ends with one another, coupling the apparatus with an article of clothing or a clothing accessory being worn by the individual;

removing at least a substantial portion of said loop of flexible material from the inner chamber of said container; and positioning said loop of flexible material around a portion of the individual whereby the first exterior surface portion and second exterior surface portion of said loop of flexible material are oriented to face away from the individual.

9. The method of claim 8 wherein:

the clothing accessory worn by the individual is provided as a belt, worn adjacent a waist portion of the individual; and said container is coupled with said belt.

10. The method of claim 9 wherein:

said loop of flexible material is positioned around a torso portion of the individual whereby (i) the second end portion of said loop of flexible material is positioned adjacent a neck and shoulder portion of the individual, (ii) the first surface portion of said loop of flexible material is oriented to face away from a chest portion of the individual, and (iii) the second surface portion of said loop of flexible material is oriented to face away from a back portion of the individual.

11. The method of claim 8 wherein:

said indicia is provided to include letters that identify the individual as a member of a law enforcement organization.

12. The method of claim 11 further comprising:

providing said indicia to be displayed on the first exterior surface portion and the second exterior surface portion or said loop of flexible material.

13. The method of claim 8 further comprising:

providing a grasping tab to extend outwardly from the exterior surface of said loop of flexible material, adjacent a second end portion of said loop of flexible material; and grasping said grasping tab with a hand of the individual while positioning said loop of flexible material around a portion of the individual.

14. The method of claim 8 further comprising:

providing the loop of flexible material whereby the first end portion of said loop of flexible material is formed from two free ends of said loop of flexible material;

forming an opening through each of the free ends of said loop of flexible material;

positioning at least a portion of said cord through the openings in the free ends of said loop of flexible material.

15. The method of claim 9 further comprising:

providing said belt with a holster at a location adjacent one side of said holster; and coupling said container with said belt, generally opposite the location of said holster.

16. In combination:

a belt, having (i) a buckle, and (ii) a holster located at one side portion of said belt; and an identification apparatus comprising:

a loop of flexible material having (i) first and second opposite end portions, and (ii) an outwardly faced exterior surface that is defined by at least a first exterior surface portion and a second exterior surface portion; said first exterior surface portion and said second exterior surface portion being oriented to face in generally opposite directions;

indicia (i) displayed on at least the first exterior surface portion of said loop of flexible material and (ii) identifying the individual as a member of an organization; and a container having an opening in communication with an inner chamber;

a length of flexible cord having opposite end portions; one end portion of said cord being connected with said container and an opposite end portion of said cord being connected with the first end portion of said loop of flexible material; at least a substantial portion of said loop of flexible material being disposed within the inner chamber of said container; the first end portion of said loop of flexible material being formed from two free ends of said loop of flexible material; the free ends of said loop of flexible material each having an opening penetrating the free ends of said loop of flexible material: at least a portion of said cord (i) extending through the openings in the free ends of said loop of flexible material and (ii) coupling the free ends with one another, said container being coupled with said belt generally opposite the location of said holster.

17. The combination of claim 16 wherein:

said indicia include letters that identify a law enforcement organization.

18. The apparatus of claim 17 wherein:

said indicia is displayed on the first exterior surface portion and the second exterior surface portion of said loop of flexible material.

19. The apparatus of claim 18 wherein:

said indicia are comprised of a reflective material.

* * * * *